United States Patent [19]

Takahashi et al.

[11] Patent Number: 4,869,347

[45] Date of Patent: Sep. 26, 1989

[54] SPEED CONTROL APPARATUS FOR ELEVATORS

[75] Inventors: Hideaki Takahashi; Noboru Arabori, both of Katsuta, Japan

[73] Assignee: Hitachi, Ltd., Tokyo, Japan

[21] Appl. No.: 227,313

[22] Filed: Aug. 3, 1988

[30] Foreign Application Priority Data

Jan. 31, 1986 [JP] Japan ..... 61-18035

[51] Int. Cl.[4] ..... B66B 1/30

[52] U.S. Cl. ..... 187/116

[58] Field of Search ..... 187/112, 116

[56] References Cited

U.S. PATENT DOCUMENTS 4,085,823 4/1978 Caputo et al. ..... 187/116
4,322,712 3/1982 Yoshida ..... 187/116 X
4,434,874 3/1984 Caputo ..... 187/116
4,503,939 3/1985 Lawrence et al. ..... 187/116

*Primary Examiner*—William M. Shoop, Jr.
*Assistant Examiner*—W. E. Duncanson, Jr.
*Attorney, Agent, or Firm*—Antonelli, Terry & Wands

[57] ABSTRACT

There is disclosed an elevator speed control apparatus, in which a final signal representative of a traveling speed to be detected is determined by changing a first provisional signal depending on the traveling speed in accordance with a second provisional signal, when a difference between the two provisional signals exceeds a predetermined value; the first provisional signal being obtained on the basis of a pulse width of a pulse from a rotary encoder rotating with the travel of the elevator and the second one being obtained on the basis of a number of pulses in the pulse train for a predetermined sampling period.

6 Claims, 5 Drawing Sheets

SPEED CONTROL APPARATUS FOR ELEVATORS

BACKGROUND OF THE INVENTION

1. Field of the Invention

The present invention relates to an improvement of a speed control apparatus for an elevator, and more particularly to an improved elevator speed control apparatus having a speed detector enabling the accurate and reliable detection of a traveling speed of the elevator, whereby the smooth speed control of the elevator can be realized.

2. Description of the Related Art

In general, a speed control apparatus for an elevator is constructed by a feed-back control system, in which there are included a speed instruction unit for producing a traveling speed instruction and a speed detector for detecting an actual traveling speed thereof. A control unit obtains a difference between the speed instruction and the actual traveling speed detected and produces a torque instruction signal in accordance with the difference. A power convertor for supplying electric power to a driving motor of the elevator is operated on the basis of the aforesaid torque instruction signal, whereby the actual traveling speed of the elevator can be controlled in accordance with the speed instruction.

As a recent trend in this field, for the rotational speed control of a driving motor of an elevator, there is often adopted a so called vector control method, which makes it possible to control the rotational speed of the motor with the very high accuracy. Accordingly, a speed detector is required to have the high detection accuracy well-matched therewith. Usually, a speed detector using a rotary encoder is employed in order to meet the requirement of the highly accurate speed detection.

The rotary encoder generates a pulse train in response to the travel of an elevator, a pulse width of each pulse of which is measured by using a clock pulse signal with a sufficiently high frequency. A traveling speed of the elevator is obtained by dividing a traveling distance of the elevator per pulse from the rotary encoder by the pulse width measured as above.

In the speed detector of the rotary encoder type as mentioned above, the traveling speed can be detected with the very high accuracy so far as normal pulses continue to be produced. However, when a defective or abnormal pulse occurs in the rotary encoder, the detected value of the traveling speed is influenced thereby and widely fluctuates. Especially in an elevator control apparatus having a power convertor which repeats the conduction and interruption of a high voltage or a large current, defective pulses are apt to be produced, because large noise is induced in a great deal.

The fluctuation in the detected value of the traveling speed in turn causes the fluctuation in the aforesaid torque instruction signal, with the result that the smooth speed control of the elevator is damaged and resultantly the rough travel thereof makes passengers uncomfortable very much.

SUMMARY OF THE INVENTION

It is an object of the present invention to provide an improved speed control apparatus for an elevator having a speed detector enabling the accurate and reliable detection of a traveling speed of the elevator even in occurrence of a defect in pulses generated with the travel of the elevator.

A feature of the present invention is in a speed control apparatus for an elevator having driving motor means driving the elevator, power convertor means for feeding the driving motor means with controlled AC electric power, speed detecting means for producing a pulse train, each pulse of which has the pulse width depending on a traveling speed of the elevator, and control unit means for making the power convertor means operate in accordance with a torque instruction signal based on a deviation between a traveling speed instruction and an actual traveling speed detected by the speed detecting means and produce the controlled AC electric power, wherein the speed detecting means obtains two kinds of provisional signals depending on the actual traveling speed, compares the two provisional signals with each other, and produces a final signal representative of the actual traveling speed on the basis of the comparison result of the two provisional signals.

With a speed control apparatus for an elevator constructed as above, an abnormal value of a detected traveling speed can be corrected or eliminated, and therefore the accurate speed detection is enabled with the high reliability, whereby the smooth speed control is made possible and the riding comfortableness is much improved.

DESCRIPTION OF THE PREFERRED EMBODIMENTS

Figure 1:
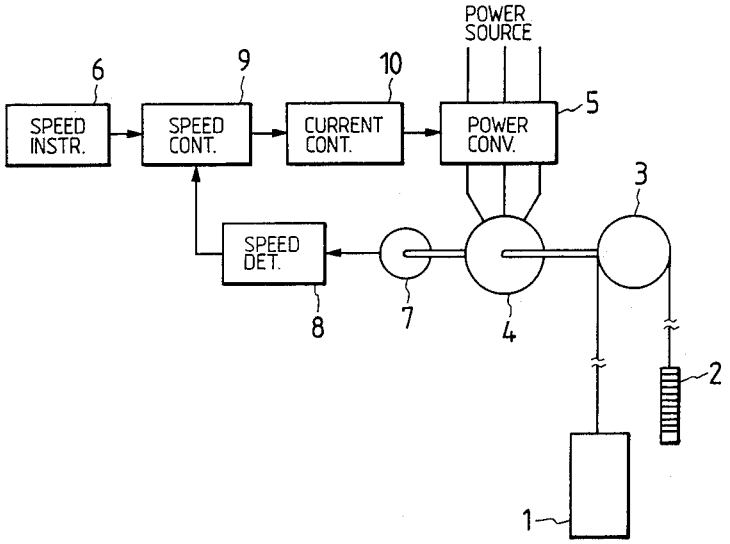
FIG. 1 schematically shows a configuration of an elevator control apparatus, which includes a speed control apparatus according to an embodiment of the present invention.

In the following, description will be made of embodiments of the present invention, referring to accompanying drawings, in which FIG. 1 schematically shows a configuration of an elevator control apparatus, which includes a speed control apparatus according to an embodiment of the present invention.

As shown in FIG. 1, in an elevator, an elevator cage 1 and a counter weight 2 are coupled to both ends of a rope, which is hung on a traction sheave 3. The traction sheave 3 is mechanically coupled to a driving motor 4, and therefore the elevator cage 1 can travel up and down within an elevator shaft, when the traction sheave 3 is driven by the driving motor 3. The driving motor 4 is fed with AC electric power controlled by a power convertor 5.

A control apparatus for the elevator as mentioned above is constructed as follows. There is provided a speed instructor 6, which produces an instruction signal of a traveling speed of the elevator in accordance with, for example, signals given from a known elevator operation management apparatus (not shown).

On the other hand, a rotary encoder 7 is mechanically coupled to an axle of the driving motor 4. Therefore, the encoder 7 can produce a pulse train with the travel of the elevator cage 1, each pulse of which has a pulse width depending on the traveling speed in terms of time. A speed detector 8 executes the necessary processing with respect to the pulse train from the encoder 7 and produces a signal representative of an actual traveling speed.

The speed instruction signal from the instructor 6 and the actual traveling speed signal from the detector 8 are given to a speed controller 9, in which both signals are compared with each other and a deviation therebetween is obtained. Further, the speed controller 9 converts the thus obtained deviation into a torque instruction signal, which is coupled to a current controller 10.

The controller 10 produces a gate signal on the basis of the torque instruction signal to control the power convertor 5. The convertor 5 operates in accordance with the gate signal and converts an AC electric power from a power source into the controlled AC electric power to supply the driving motor 4 therewith.

As already described, the accurate speed detection has been required with the use of the vector control method for the rotational speed control of a driving motor. To this end, there has been used a speed detector as described below. The operational principle of such a speed detector will be explained with reference to FIG. 2. Incidentally, a pulse generated by the encoder 7 will be called simply an encoder pulse in the following description.

First of all, pulse widths of encoder pulses are measured by using a clock pulse signal with the sufficiently high frequency. Namely, during an encoder pulse assumes its high state (cf. FIG. 2(*b*)), clock pulses (cf. FIG. 2(*a*)) are counted by a counter, which is reset every time of occurrence of a leading edge of each encoder pulse.

Figure 2:
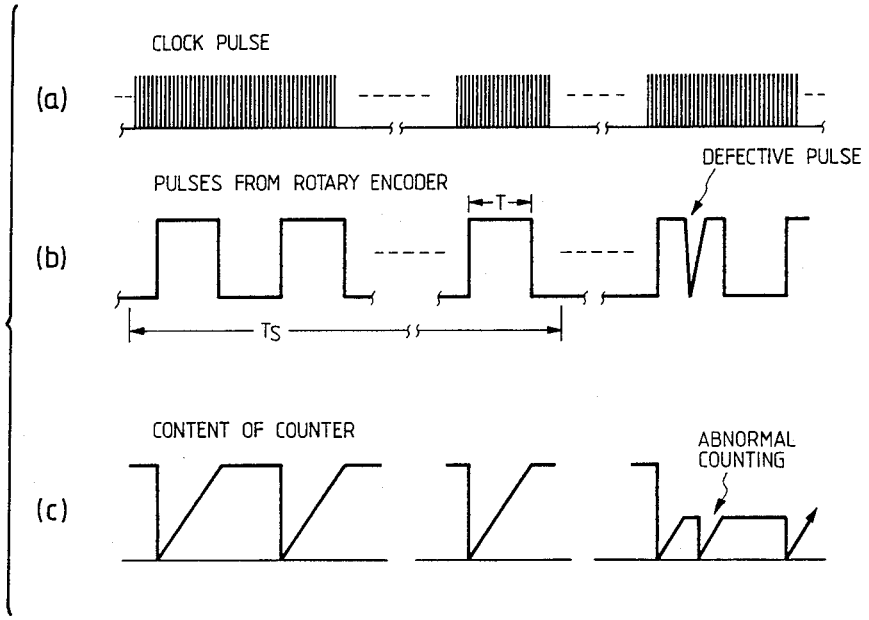
FIG. 2 is a drawing for explaining the principle of the speed detection in the speed control apparatus included in the elevator control apparatus of FIG. 1.

As a result, the content of the counter changes as shown in FIG. 2(*c*), and the width T of each encoder pulse can be learnt from the content of the counter. Since each encoder pulse has a weight corresponding to a predetermined traveling distance of the elevator, the traveling speed thereof can be obtained by dividing the traveling distance per encoder pulse by the pulse width T obtained as above.

If, however, a defective pulse as shown in FIG. 2(*b*) occurs in the encoder 7, the normal counting operation of the counter is disturbed as shown in FIG. 2(*c*), with the result that a large error is included in the detected value of the traveling speed of the elevator. This is because the traveling speed is obtained on the basis of the pulse width T only, which has been measured by the clock pulse. Then, the speed detection is improved as follows.

Figure 3:
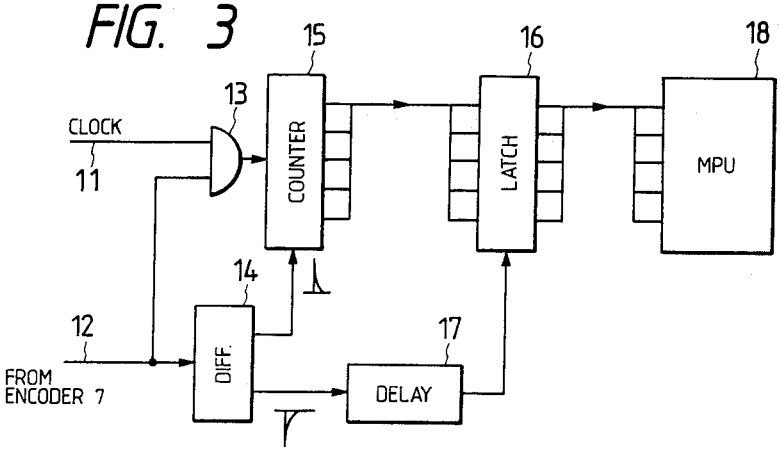
FIG. 3 schematically shows a configuration of one of examples of a speed detector used in the speed control apparatus in FIG. 1.

Referring at first to FIG. 3, an example of an improved speed detector will be discussed.

As shown in the figure, clock pulses and encoder pulses are applied to a gate 13 through lines 11 and 12, respectively. The encoder pulses are also applied to differentiation circuit 14, which produces two kinds of signals by differentiating a leading edge and a trailing edge of each encoder pulse. A differentiation signal obtained from the leading edge is applied to counter 15 as a reset signal and another differentiation signal obtained from the trailing edge is used as a latch signal as described later.

When the encoder pulse occurs, the counter 15 is cleared and starts to count the clock pulses only during the encoder pulse assumes the high state. Therefore, the counter 15 can measure the pulse width T of the encoder pulse, similarly to the counter of the prior art as already described.

The content of the counter 15 is transferred to latch 16 and held therein, when the latch signal is given to the latch 16 through delay element 17, in which the latch signal is delayed by a predetermined time. Further, the content held in the latch 16 is taken in microprocessor unit (MPU) 18.

MPU 18 is a processor, which executes various tasks necessary for the elevator control. As one of those tasks, there is included a traveling speed determination processing operation as described below, which is executed every processing time interval assigned to this task. Therefore, MPU 18 takes data from the latch 16 every time of the processing time interval and calculates the traveling speed of the elevator on the basis of the data taken therein.

Referring next to a flow chart of FIG. 4, the processing operation for determination of the traveling speed will be described hereinafter. As described above, this processing operation is executed every processing time interval, which corresponds to a sampling period $T_s$ as shown in FIG. 2(*b*). This time interval or sampling period $T_s$ is determined in view of the priorities of all the tasks to be executed by MPU 18.

After the initiation of the processing operation, at step 41, a first signal v(n) depending on the traveling speed is calculated on the basis of the pulse width T of the encoder pulse, wherein v(n) means a signal based on one of the encoder pulses produced during $T_s$ of the n-th sampling period. The signal v(n) can be calculated in the same manner as that in the prior art, which has been already described.

In this calculation, there is used the content of the counter 15, which is obtained by counting the clock pulses during existence of the last one of the encoder pulses produced in the n-th sampling period, because MPU 18 executes the processing operation for this calculation every sampling period $T_s$.

Next, at step 42, there is obtained a difference $\Delta v(n)$ between the first signal v(n) and a second signal $v(n-1)$. The second signal $v(n-1)$ used in this step is a signal already calculated in the last, i.e., $(n-1)$-th, sampling period. As apparent from this, two kinds of signals, i.e., the first and second signals, are employed to finally determine a detected value of the actual traveling speed. In this sense, the first and second signals described above will be called provisional signals, hereinafter.

An absolute value of the difference $\Delta v(n)$ is compared with a constant value $V_a$ set in advance, at step 43. If the absolute value of the difference $\Delta v(n)$ is smaller than $V_a$, the first provisional signal v(n) is stored in an appropriate storage within MPU 18 as the detected value of this time at step 44.

Otherwise, the provisional signal $v(n-1)$, which has been already obtained last time, is taken as the detected value of this time at step 45, and then it is stored at step 44. The stored value v(n) is used as the actual traveling speed in the other processing operation for the elevator control.

In this manner, if a value of the first signal v(n) calculated on the pulse width T of the encoder pulse in this sampling period is extremely large, i.e., in the example shown, by the predetermined value $V_a$ larger than v(n−1) calculated in the last sampling period, such a large v(n) is regarded as having been caused by a defective pulse as shown in FIG. 2(*b*), and the value of v(n−1) of last time is taken as v(n) of this time. As a result, since v(n−1) must be calculated on the basis of the pulse width of a normal encoder pulse, a large error is prevented from being included in the speed control of the elevator.

Figure 5:
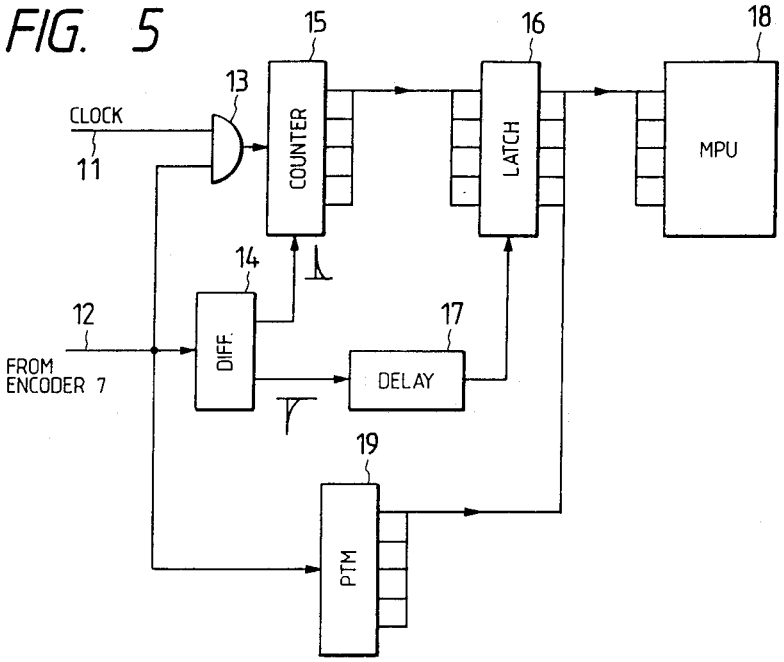
FIG. 5 schematically shows a configuration of another example of the speed detector used in the speed control apparatus in FIG. 1.

Referring next to FIG. 5, another example of the speed detector will be explained. In the figure, the same reference numerals denote the same parts as in FIG. 3. In the speed detector of FIG. 5, a programmable timer module (PTM) 19 is added to the detector of FIG. 3. Also in this example, the processing operation for the determination of the traveling speed is executed every sampling period $T_s$, which can be programmed in advance at a given value in PTM 19.

PTM 19 is a counter, which counts the encoder pulses for the period $T_s$ and produces the count result to MPU 18 every sampling period $T_s$. It will be easily understood from the inherent nature of encoder pulses that a traveling speed of an elevator can be also determined by counting the encoder pulses themselves for a constant time duration, e.g., the sampling period $T_s$. Namely, there is the following relation in a speed signal obtained in the manner as described above and the number of the encoder pulses counted for the sampling period $T_s$.

$$v'(n) = K\frac{P(n)}{T_s} \quad (1)$$

In the formula above, v'(n) and P(n) represent the speed signal and the counted number with respect to the n-th sampling period $T_s$, and K is constant.

MPU 18 in this example takes therein the contents of both the counter 15 and PTM 19 every sampling period, in which two kinds of signals of values depending on a traveling speed can be calculated on the basis of two different data. Namely, a first one thereof is v(n) calculated on the basis of the pulse width T of the encoder pulse and a second one is v'(n) calculated on the basis of the number of the encoder pulses for the sampling period. Further, MPU 18 obtains a final signal representative of the traveling speed on the basis of these two signals v(n) and v'(n). In this sense, therefore, v(n) and v'(n) can also be called provisional signals.

The processing operation of MPU 18 will be described with reference to a flow chart of FIG. 6. After start of the processing operation, at step 61, the calculation of a first provisional signal v(n) is executed on the basis of the pulse width T of the encoder pulse, which is measured by the counter 15 and taken into MPU 18. This step is similar to step 41 in FIG. 4.

Then, at step 62, the calculation of a second provisional signal v'(n) is carried out on the basis of the number of the encoder pulses for the sampling period $T_s$, which is counted by PTM 19 and taken into MPU 18. At step 63, there is obtained a difference Δv'(n) between the first and second provisional signals v(n) and v'(n).

At step 64, an absolute value of the difference Δv'(n) is compared with a predetermined value $V_b$. If the difference Δv'(n) is smaller than $V_b$ in its absolute value, the first provisional signal v(n) is set as a final signal representing the traveling speed of the elevator in the n-th sampling period at step 65.

Otherwise, at step 66, the first provisional signal v(n) calculated at step 61 is corrected in accordance with a formula indicated within a block of this step on the basis of the difference Δv'(n) obtained at step 63. Incidentally, in the formula, K is a constant. Then, at step 65, new v(n) thus corrected is set as the final signal representing the traveling speed in the n-th sampling period.

Figure 4:
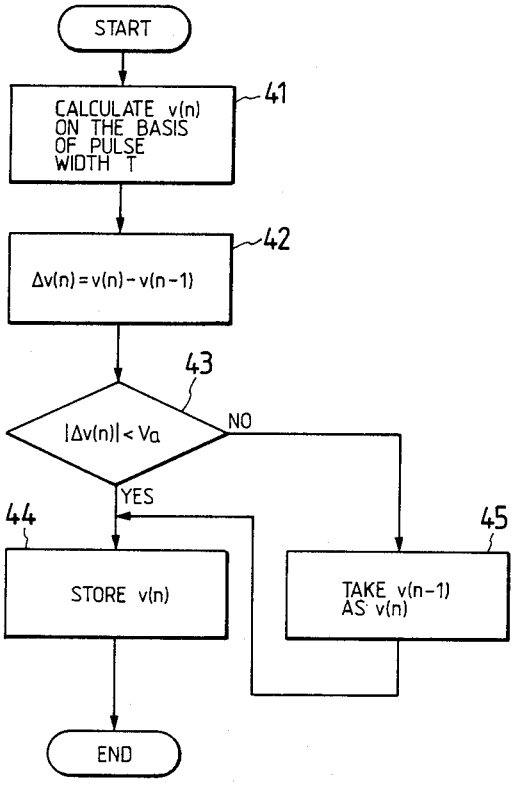
FIG. 4 is a flow chart for explaining the operation of the speed detector shown in FIG. 3.

As a substitution for step 66, there can be provided a step analogus to step 45 in FIG. 4. Namely, the value v(n−1) calculated in the last sampling period is taken as the value v(n) of the sampling period of this time. In this case, similarly to FIG. 4, it is necessary to provide a step of storing v(n) corresponding to step 44 in FIG. 4.

Also in this example, the final signal representative of the traveling speed of the elevator is determined on the basis of two different kinds of the provisional signals v(n) and v'(n) If a defective pulse as shown in FIG. 2(*b*) occurs in the encoder 7, the first signal v(n) is influenced to a great extent, but nevertheless the second signal v'(n) does not receive the influence thereof so much.

Therefore, even if a defective encoder pulse occurred and an error was included in the count result of the counter 15 as shown in FIG. 2(*c*), a signal finally obtained as the traveling speed can be made a signal having the less influence of the defective encoder pulse by correcting the first provisional signal v(n) calculated on the basis of the wrong count result in accordance with the degree of the deviation between the first and the second provisional signals. As a result, the smooth speed control of the elevator can be realized.

Figure 7:
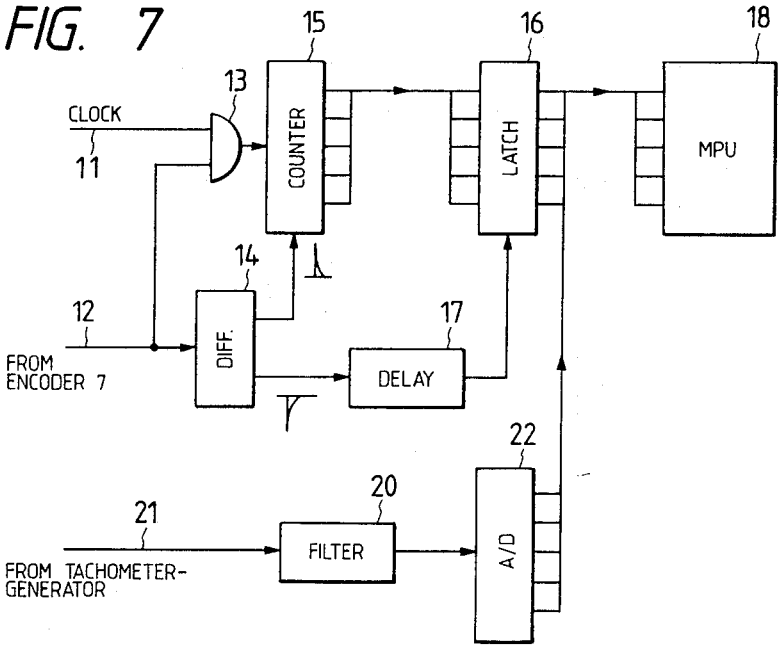
FIG. 7 schematically shows a configuration of still another example of the speed detector used in the speed control apparatus in FIG. 1.

Referring further to FIG. 7, still another example of the speed detector will be explained. In the figure, the same reference numerals denote the same parts as in the foregoing figures. This is the case where an elevator speed control apparatus has a tachometer-generator (not shown), which produces an analog signal in proportion to a traveling speed of an elevator. Such a tachometer-generator can be provided as usual, e.g., attached to the axle of the driving motor 4.

In the speed detector of FIG. 7, there are provided filter 20 and analog/digital (A/D) convertor 22, in place of PTM 19 in FIG. 5. An analog speed signal produced by the tachometer-generator is coupled to the filter 20 through line 21, in which it is filtered. After that, the analog speed signal is converted into the digital form by the A/D convertor 22. The speed signal converted into the digital form is taken in MPU 18 every sampling period $T_s$ and employed therein as a second provisional signal v''(n). Similarly to the case of the foregoing examples, also in this case, a first provisional signal is the signal v(n) calculated on the basis of the pulse width T of the encoder pulse.

Figure 8:
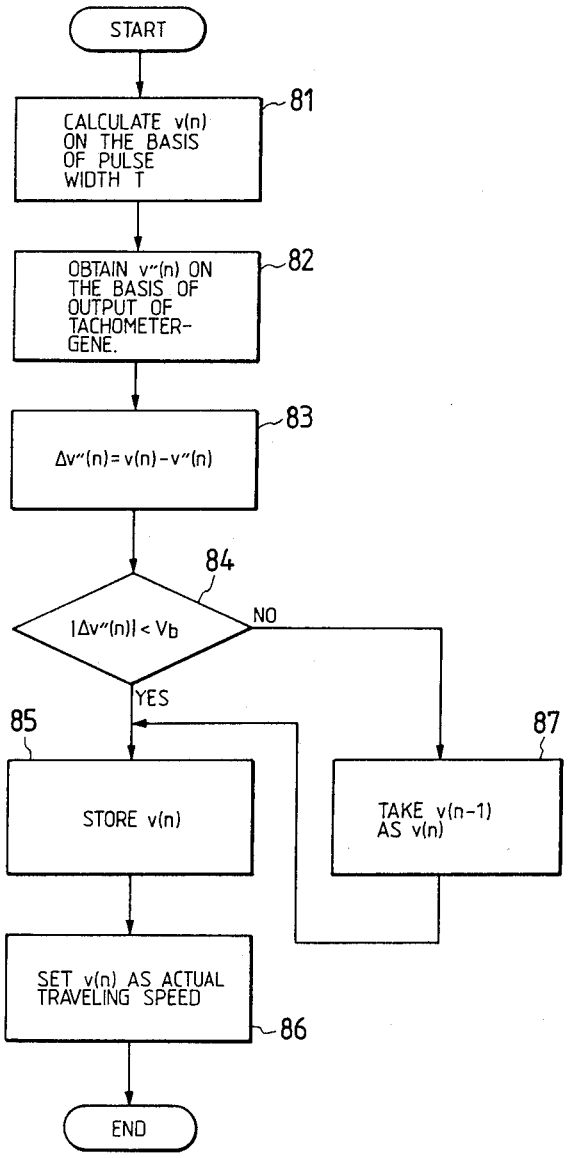
FIG. 8 is a flow chart for explaining the operation of the speed detector shown in FIG. 7.

FIG. 8 is a flow chart illustrating the processing operation of MPU 18 in the speed detector of FIG. 7. As will be understood from the flow chart, the processing operation of MPU 18 in FIG. 7 is almost the same as that in FIG. 5. Therefore, detailed description of this flow chart is omitted here for the purpose of avoidance of unnecessary prolixity of the specification, and only the difference thereof from that of FIG. 6 will be explained in the following Such difference is as follows.

Figure 6:
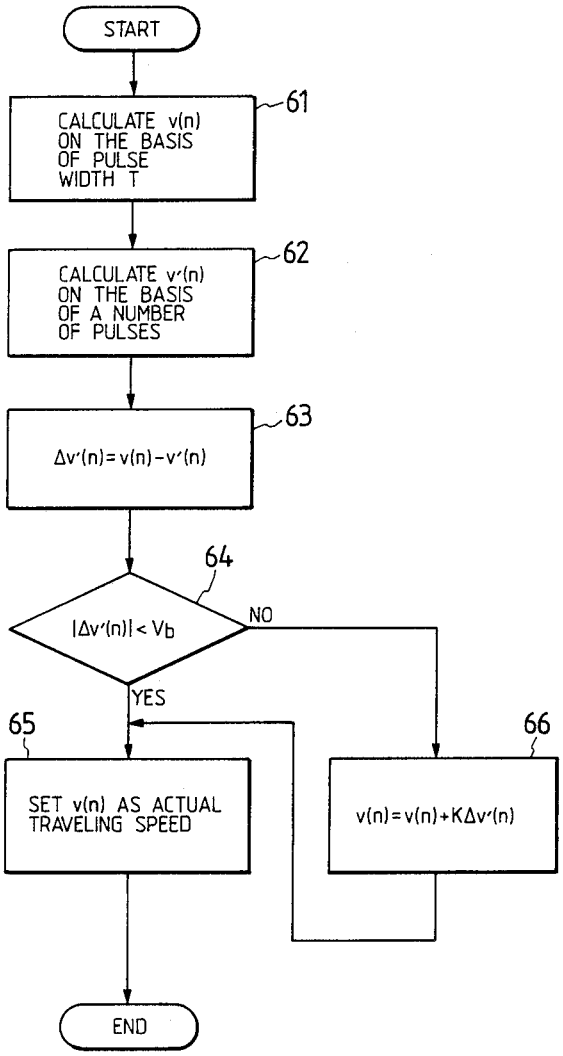
FIG. 6 is a flow chart for explaining the operation of the speed detector shown in FIG. 5.

First of all, the signal v''(n) obtained on the basis of the output signal of the tachometer-generator (cf. step 82) is employed as the second provisional signal, in place of the signal v'(n) obtained on the basis of the number of the encoder pulses in the flow chart of FIG. 6. Secondly, the manner of determining a final signal of the traveling speed is the same as that in the flow chart of FIG. 4, rather than that in the flow chart of FIG. 6. Namely, if-the absolute value of $\Delta v''(n)$ is larger than $V_b$, v(n−1) calculated in the (n−1)-th sampling period is taken as v(n) of the n-th sampling period. To this end, steps 87 and 85 are provided in the analogous manner to the flow chart of FIG. 4.

Generally, noise included in an analog signal can be easily removed, compared with that in a digital signal, and therefore the advantage caused by the first difference as mentioned above is in that the second provisional signal v''(n) can easily be made a signal including less noise, in comparison with that in the foregoing examples.

Accordingly, although the accuracy of the analog speed detection by a tachometer-generator may be inferior to the digital speed detection, such a disadvantage in the analog speed detection is not questioned at all, because a tachometer-generator is only used as auxiliary measures during the abnormal state and the digital detection is always carried out in the normal state. The analog detection only compensates the digital detection when a defective pulse occurs in the rotary encoder.

The second difference of this example as mentioned above is of an optional matter. Namely, it is of course that there can be used also in the flow chart of FIG. 8 the same manner of determining the final signal of the traveling speed as indicated in step 66 of the flow chart of FIG. 6. At that time, step 85 in the flow chart of FIG. 8 is not always necessary to be provided.

As described above, according to this example, the smooth speed control in an elevator can be realized with the very high accuracy and reliability, because the influence of a defective encoder pulse is eliminated from the speed detection of the traveling speed of the elevator.

Although some forms of apparatus embodying the present invention have been shown and described, it is understood that various changes and modifications may be made therein within the scope of the appended claims without departing from the spirit and scope of the present invention.

We claim:

1. A speed control apparatus for an elevator, having:
driving motor means for driving the elevator;
power convertor mean for feeding said driving motor means with controlled AC electric power;
speed detecting means for detecting a traveling speed of the elevator and producing a pulse train, each pulse of which has the pulse width depending on the traveling speed; and
control unit means for making said power convertor means operate in accordance with a torque instruction signal based on a deviation between a predetermined speed instruction and an actual traveling speed detected by said speed detecting means and produce the controlled AC electric power,
characterized in that
said speed detecting means obtains two kinds of provisional signals depending on the actual traveling speed, compares the two provisional signals with each other, and produces a final signal representative of the actual traveling speed on the basis of the comparison result of the two provisional signals.

2. A speed control apparatus for an elevator as defined in claim 1,
characterized in that
a first one of the two provisional signals is obtained on the basis of the pulse width of a certain pulse of the pulse train produced by said speed detecting means and a second provisional signal is obtained on the basis of the pulse width of a pulse previous to the certain pulse.

3. A speed control apparatus for an elevator as defined in claim 1,
characterized in that
a first one of the two provisional signals is obtained on the basis of the pulse width of a certain pulse of the pulse train produced by said speed detecting means and a second provisional signal is obtained on the basis of a number of pulses in the pulse train for a predetermined sampling period.

4. A speed control apparatus for an elevator as defined in claim 1,
characterized in that
there is further provided a tachometer-generator for detecting the traveling speed of the elevator and producing an analog speed signal in proportion to the traveling speed;
a first one of the two provisional signals is obtained on the basis of the pulse width of a certain pulse of the pulse train produced by said speed detecting means; and
a second provisional signal is obtained on the basis of the analog speed signal obtained by said tachometer-generator.

5. A speed control apparatus for an elevator as defined in claim 1,
characterized in that
said speed detecting means obtains a difference between the first and the second provisional signals, and sets the second provisional signal as a final signal representative of the actual traveling speed, when the difference is larger than a predetermined value.

6. A speed control apparatus for an elevator as defined in claim 1,
characterized in that
said speed detecting means obtains a difference between the first and the second provisional signals and, when the difference is larger than a predetermined value, corrects the first provisional signal on the basis of the difference to output a corrected signal as a final signal representative of the actual traveling speed.

* * * * *